US009679519B2

(12) United States Patent
Lebrun

(10) Patent No.: US 9,679,519 B2
(45) Date of Patent: Jun. 13, 2017

(54) ELECTRO-OPTICAL DEVICE WITH LARGE PIXEL MATRIX

(71) Applicant: THALES, Courbevoie (FR)

(72) Inventor: Hugues Lebrun, Coublevie (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/891,295

(22) PCT Filed: May 16, 2014

(86) PCT No.: PCT/EP2014/060156
§ 371 (c)(1),
(2) Date: Nov. 13, 2015

(87) PCT Pub. No.: WO2014/184373
PCT Pub. Date: Nov. 20, 2014

(65) Prior Publication Data

US 2016/0086547 A1 Mar. 24, 2016

(30) Foreign Application Priority Data

May 17, 2013 (FR) ..... 13 01138

(51) Int. Cl.
*G09G 3/32* (2016.01)
*G09G 3/3258* (2016.01)
*G09G 3/3233* (2016.01)

(52) U.S. Cl.
CPC ..... *G09G 3/3258* (2013.01); *G09G 3/3233* (2013.01); *G09G 2300/0404* (2013.01); *G09G 2300/0421* (2013.01); *G09G 2300/0426* (2013.01); *G09G 2300/0866* (2013.01); *G09G 2320/0223* (2013.01); *G09G 2320/0233* (2013.01); *G09G 2330/028* (2013.01)

(58) Field of Classification Search
CPC ... G09G 3/3614; G09G 3/3208; G09G 3/3258
See application file for complete search history.

(56) References Cited

U.S. PATENT DOCUMENTS 5,841,410 A 11/1998 Oda et al.
2001/0043168 A1 11/2001 Koyama et al.
(Continued)

FOREIGN PATENT DOCUMENTS

CN 101 859 541 A 10/2010
EP 1 850 393 A2 10/2007
WO 2005/122120 A2 12/2005

*Primary Examiner* — Olga Merkoulova
(74) *Attorney, Agent, or Firm* — Baker & Hostetler LLP

(57) ABSTRACT

At least one of the two rectangular conducting planes, provided to apply a voltage across the terminals of each pixel of a matrix, is supplied via two adjacent edges from individual voltage sources distributed along each of the edges. The voltage sources have different values of voltage, preferably but not necessarily varying in a monotonically increasing manner between a lower value at the end near the junction between the two edges and a higher value at the other end of each of the edges. The two edges through which the first conducting plane is mainly supplied are cut out to form electrical contact points locally isolated from one another and regularly spaced, each supplied by a respective individual voltage source. The other conducting plane may be supplied in the same way.

19 Claims, 5 Drawing Sheets

(56) References Cited

U.S. PATENT DOCUMENTS

| | | | | |
|---|---|---|---|---|
| 2005/0258771 | A1 | 11/2005 | Kang et al. | |
| 2006/0202934 | A1 | 9/2006 | Shin et al. | |
| 2009/0256820 | A1* | 10/2009 | Yanase | G06F 3/0412 345/174 |
| 2012/0293481 | A1* | 11/2012 | Chaji | G06F 3/038 345/212 |

* cited by examiner

ELECTRO-OPTICAL DEVICE WITH LARGE PIXEL MATRIX

CROSS-REFERENCE TO RELATED APPLICATIONS

This application is a National Stage of International patent application PCT/EP2014/060156, filed on May 16, 2014, which claims priority to foreign French patent application No. FR 1301138, filed on May 17, 2013, the disclosures of which are incorporated by reference in their entirety.

FIELD OF THE INVENTION

The field of the invention is that of large-matrix electro-optical devices, more specifically those of the active matrix type.

The invention is applicable, notably, to light-emitting diode display screens, particularly those having organic light-emitting diodes. It may be applied to other types of electro-optical devices, for example image sensors or lighting devices.

BACKGROUND

In large electro-optical devices, a problem arises in respect of the power distribution to each of the pixels in the matrix. This power distribution is provided by power conducting planes which cover the surface of the pixel matrix and which are each connected to a power source at one or more electrical contact points distributed over the edges of the plane, generally via a flexible connector with low terminating impedance.

Since these conducting planes have to supply current to a large number of pixels simultaneously, their surface resistance leads in practice to voltage drops, which must be compensated for by applying a higher voltage than that which would normally suffice for driving an individual pixel.

The structure and the material or materials of the conducting planes are determined primarily by constraints which arise from the technology and topology of the device concerned, and which, notably, depend on whether or not the conducting plane is on a light transmission path, the location of the conducting plane in the stack of layers of the matrix, and particularly whether the conducting plane has to be formed on top of fragile layers, which rules out certain manufacturing processes such as high-temperature processes. All these constraints must be taken into account in the production of the conducting planes, while attempting to achieve the lowest possible resistance per unit of surface area. Other constraints may arise from the proposed applications: in lighting devices, the choice of conductive materials is constrained by the objective of very low cost, to the detriment of their conductivity.

A further constraint on large active matrices relates to the density of the address lines, which makes it impossible to provide points of connection to the power source along the whole periphery of the power conducting plane.

To aid the understanding of the last-mentioned problem, FIG. 1 shows a schematic illustration of an active pixel matrix $p_{i,j}$. Each pixel $p_{i,j}$ comprises a pixel element and an associated elementary control circuit. Each pixel $p_{i,j}$ is conventionally positioned at the intersection of a row $l_i$ and a column $col_j$ of the matrix (i is an integer varying from 1 to n, and j is an integer varying from 1 to m). The matrix is inscribed within a rectangular region denoted ZA, generally called an active zone. The addressing circuits SELX and SELY of the rows and columns are arranged on the periphery of this active zone ZA, along two adjacent edges b1 and b2, corresponding to the top and left-hand edge of the active zone ZA in the figure.

These addressing circuits SELX and SELY are connected to pixel address lines: the addressing circuit SELX drives the selection lines $sel_i$, each of which enables a corresponding row $l_i$ of pixels to be selected; the addressing circuit SELY drives the data lines $dat_j$, each of which enables a display data element to be transmitted to a corresponding column $col_j$ of pixels; this data element is transmitted to the pixel element of the pixel $p_{i,j}$ at the intersection of the row $l_i$ and the column $col_j$, via the elementary control circuit (active matrix) of the pixel.

In the case of a large matrix, the density of the address lines $sel_i$ and $dat_j$ driven by the circuits SELX and SELY and the constraints associated with the required electrical performance of these circuits are such that the power supplies cannot be connected to the conducting planes via the edges along which these circuits are placed. Thus a conducting plane can be connected to a power source only via the two adjacent edges b3 and b4 which are opposite the edges b1 and b2 along which the addressing circuits are positioned.

This is shown schematically in FIG. 2. A power conducting plane P1 of rectangular shape covers the surface of the active zone ZA. It is connected to a voltage source ALIM which supplies a voltage VDD to be applied to each of the pixels of the matrix. Another conducting plane, or earth plane, not shown in FIGS. 1 and 2, supplies a common earth potential VSS to the pixels. The connection to the power source can be provided by one or more electrical contact points, shown as points c1, c2, c3 and c4 in the example, positioned on the periphery of the conducting plane P1, but only along the edges b3 and b4. The distance between each pixel power source varies according to the position of the pixel in the matrix: the resulting voltage drop is much more marked in the pixels located in the upper left-hand part of the matrix, such as pixel $p_{1,1}$, which are farther from the contact points than those such as pixel $p_{n,m}$, located in the lower right-hand part in the proximity of these points.

To compensate for the voltage drop in the pixels most remote from the points of connection to the power source, the voltage VDD supplied by the power source is set at a higher level than would normally be required to control a single pixel, in order to ensure that even the most remote pixels can be controlled and the desired luminance can be obtained.

The problem of voltage drops due to the intrinsic resistivity of the conducting plane supplying the voltage VDD is present in the same way on the earth plane side, if a sufficiently conductive earth plane cannot be formed: the pixels located remotely from the contact points receive a voltage of less than VDD, while also receiving a voltage greater than VSS from the other side; there is a risk that the voltage across their terminals will be less than a threshold below which the pixels can no longer emit light, if the emitting element is an organic or inorganic light-emitting diode.

These problems of power distribution are, notably, one of the obstacles to the development of active matrix OLED devices for large sizes, although the invention is applicable to inorganic LED matrices.

FIG. 3 shows a conventional diagram of a pixel $p_{i,j}$ of an active matrix OLED. The pixel $p_{i,j}$ comprises an organic light-emitting diode $D_{(OLED)}$, comprising, in practice, one or more diodes in series, and formed by a stack of organic layer(s) and an elementary control circuit based on thin film transistors (TFT) (T1 and T2) formed under the organic stack (on a transparent substrate), this circuit being driven by the respective address lines $sel_i$ and $dat_j$. The concept of an active matrix corresponds to the set of elementary control circuits integrated into the matrix, one in each pixel region, by means of which the pixels are driven.

The elementary control circuit comprises:

a selection transistor T1, whose gate g1 is connected to a row selection line $sel_i$, and a source/drain electrode connected to a data line $dat_j$ (using the notation conventions of FIGS. 1 and 2); and a current control transistor T2 whose gate g2 is connected to the other source/drain electrode of the selection transistor T1. This control transistor T2 is connected in series with the diode $D_{(OLED)}$, between a supply voltage source VDD which can supply the current required for light emission and a reference potential VSS, connected to an electrical earth plane GND. In the example, one source/drain electrode of the control transistor T2 is thus connected to an electrode (the anode) of the diode, and the other is connected to the supply voltage source VDD.

A storage capacitance $C_s$ is also generally provided between the gate g2 of the control transistor and the source/drain electrode that is not connected to an electrode of the diode. This capacitance keeps the display control voltage applied to the gate of the transistor T2 over the whole image frame (the selection lines being selected one by one in sequence).

The diagram of FIG. 3 is provided by way of example. It could be more complex and could incorporate devices for correcting non-uniformity or compensating for performance drift, but a branch with the OLED and the control transistor in series is present in all cases.

The pixel display command is executed as follows: the pixel $p_{i,j}$ is selected for display by the application of a selection signal on the line $sel_i$; the transistor T1 becomes conducting and transmits to the gate g2 of the control transistor T2 an applied control voltage on the line $dat_j$, corresponding to a display data element received for this pixel by the circuit SELY. The transistor T2 biased in this way draws a current i that flows through the diode, which can then emit a corresponding amount of light. This current is supplied by the electrical power source VDD and flows through the earth plane GND.

The current is thus supplied to the pixels by the two conducting planes located on either side of the organic stack forming the OLED diode. The upper conducting plane is formed on top of the organic stack. The lower conducting plane is commonly integrated and/or produced together with the thin layers forming the active matrix and therefore the transistors, the selection lines $l_i$ and the data lines $dat_j$ driving the control circuits.

Regardless of the type of emission (from top or bottom), the lower conducting plane may be made in the form of a thick metal grid, with a mesh corresponding to the pitch of the pixels so as to correspond to the active matrix topology. It is made of gate metal or source/drain metal, and therefore has a low resistance (0.2 ohms per square). Owing to the structure of the grid, however, the resistance per unit of actual surface area of this conducting plane is higher, by about 1 ohm per square for a surface occupancy of 20%. In the case of emission from the bottom, a compromise must be sought between the pixel aperture rate which is preferably as high as possible and the voltage drop on the pixels which is preferably minimized (as the aperture rate increases, the current density decreases, thereby increasing the voltage drop in the pixel).

The upper conducting plane is formed on the organic stack. When the emission is downward, this conducting plane does not have to be transparent. It is then typically formed as a thick metal layer, typically made of aluminium with a very low surface resistance.

In the case of upward emission, however, this conducting plane must be at least partially transparent. Because of the fragility of the organic layers, it is formed by vacuum evaporation through a mask. This conducting plane cannot be made in the form of a thick metal grid if this method is used. Thus the upper conducting plane has to have a solid plate structure which is conductive and at least partially transparent. Even if a transparent conductive oxide such as indium tin oxide (ITO) can be deposited at low temperature while retaining this material's properties of high transparency, at about 90%, these conditions of use do not allow good properties of electrical conductivity to be obtained. In practice, the best possible result is a resistance per unit of surface area of about 20 ohms per square.

Thus it is preferable to make the conducting plane in the form of a thin layer of a metal which is a very good conductor, for example gold. In this way, a transparent conducting plane (with a transmission of more than 80%) can be obtained, with a surface resistance of about 4 ohms per square.

Because of these various constraints concerning the light transmission, the fragility of the organic layers and the active matrix topology in these OLED screens, it is impossible to make conducting planes with sufficiently low resistance according to the prior art, especially in the case of upward light emission. In the case of downward light emission, the conducting planes are less resistive and may be structured in the form of a grid by photolithography before the deposition of the fragile OLED layers, but because of the active matrix, on the one hand, and the fact that they have to allow light to pass through, on the other hand, the grid can only occupy a fraction of the surface. The resistivity of the conducting plane increases in a way that is inversely proportional to its surface occupancy. Furthermore, it is necessary to compensate for the loss of emission surface by an increase in the luminous intensity emitted by the OLED, to obtain good luminance properties, which may have an effect on the service life.

In both cases, in order to avoid a loss of display luminance, it therefore becomes necessary to overdesign the electrical power sources VDD or VSS, so that the potential difference applied between the two conducting planes allows the diode and the current control transistor of each pixel of the matrix to be biased, regardless of the position of this pixel (identified by a selection line and a corresponding data line) in this matrix.

If this is done, the power budget is degraded. Furthermore, it has no effect on the non-uniform distribution of the voltage applied to the terminals of the pixels, and therefore on the gradation of the resulting luminance.

For example, let us consider an upwardly emitting OLED screen in which the OLED diode is formed by a stack of two or three colour diodes, providing white light emission. The supply voltage VDD must be defined so as to allow the OLED diode and the current control transistor to be biased to the conducting state, regardless of the displayed image, and notably when the image to be displayed is entirely white, corresponding to maximum current consumption in the diodes: in these conditions, the voltage drop in the conducting plane is also highest.

Typically, in the case of an OLED diode formed by a stack of two or three colour diodes, for emission in white, the bias voltage of the pixels (the diode and the control transistor) must therefore be at least 7.5 volts. To allow for the variations in threshold voltage, notably, a higher voltage setting is used, for example 10 volts.

Let us assume that a totally white image is to be displayed with a target brightness of 600 candelas per square meter on a large screen measuring 15.4 inches.

With an OLED diode having an efficiency of 20 candelas per ampere and an upper conducting plane having a surface resistance of 4 ohms per square, supplied via two adjacent edges (b3 and b4 in FIG. 2), it is actually necessary to provide a higher supply voltage VDD of 16 volts in order to obtain 10 volts between the electrodes of the pixel $p_{1,1}$ located in the upper left-hand corner, opposite the two edges b3, b4. The power consumption is about 243 watts, which can be divided into 33 watts for the upper conducting plane supplying the voltage VDD (disregarding the voltage in the plane connected to earth) and 210 watts in the diodes. Assuming that it is possible to supply all the pixels uniformly, at the minimum voltage of 10 volts, the power consumption will be about 158 watts.

FIG. 4 shows the distribution of the supply voltage (VDD-VSS) at the terminals of the pixels as a function of their position in a matrix, and thus as a function of their distance from the points of connection of the conducting plane to the power source VDD (16 volts), and of their distance from the points of connection to the earth plane GND if the earth plane is equally resistive. This distribution, estimated on the basis of the modelling of the current consumption in each pixel, demonstrates the gradual loss over the pixels, as a function of the distance from the connection point to the voltage source, which is also manifested as a gradual loss of luminance.

In order to overcome this problem of the voltage drop in the conducting planes, some researchers are working on different pixel control systems, while others are seeking structures and materials for conducting planes that will enable their surface resistance to be reduced.

SUMMARY OF THE INVENTION

The aim of the invention was to find a simpler solution that could be applied without difficulty to present-day OLED screen technology.

As claimed, the invention relates to a pixel matrix electro-optical device, having a first and a second conducting plane supplying a first and a second supply voltage to each pixel of the matrix, the first conducting plane being rectangular and supplied mainly via two adjacent edges, characterized in that the power supply to the first conducting plane, at least, is provided from a series of individual voltage sources distributed along each of the two adjacent edges, the voltage sources being adapted to apply different respective voltages to a series of contact points provided on each of the two adjacent edges of the plane, and in that the voltages applied to these contact points by the voltage sources vary in a monotonic manner between a first value at a first contact point at the end near the junction between the two adjacent edges and a second value at a final point at the other end of each of the edges, with a monotonically increasing variation for a power conducting plane that supplies current, or a monotonically decreasing variation for a power conducting plane that draws current. The expression "supplied mainly via two adjacent edges" is to be interpreted as meaning that devices comprising other power supply connections, for example connections via the corners of the conducting planes, are not to be excluded from the scope of protection conferred by the claimed invention.

The values of the voltage sources vary in a monotonic manner between a first value at the end near the junction between the two adjacent edges and a second value at the other end of each of the edges, and more precisely in a monotonically increasing manner for a power conducting plane that supplies current or in a monotonically decreasing manner for a power conducting plane that receives current.

Preferably, the value of the voltage sources is made to vary in a monotonically increasing manner (for a power conducting plane supplying current) or in a monotonically decreasing manner (for a power conducting plane drawing current), between the first value and the second value.

According to a second embodiment of the invention, the voltages supplied by the voltage sources are adapted to the content of the image to be displayed, so as to optimize the potential difference between the conducting planes at all points of the electro-optical device. The voltages are to be varied in such a way as to optimize the potential difference between the conducting planes at all points of the electro-optical device, as a function of the displayed image itself, because this image may include brighter or dimmer areas which draw more or less current accordingly. Thus, regardless of the image, a minimum amount of power is consumed. The distribution of the voltages along the edges may therefore take any form, including the possibility of simply disconnecting some of the voltage sources.

In the case of an image to be displayed which is to have a uniform hue in all the pixels, the determined values will vary in a monotonic manner (increasing or decreasing as required) between a first value at the end near the junction between the two adjacent edges and a second value at the other end of each of the edges. Since the pixels generally have to be supplied from two conducting planes, namely a power supply plane at a voltage VDD and an earth plane at a voltage VSS, the following two solutions may be provided:

the variation of the value of the voltage sources takes place on the edges of only one of the two conducting planes, and makes allowance for the voltage drops on this conducting plane, the other conducting plane being sufficiently conductive to allow the voltage drops due to its resistivity to be disregarded;

the variation of the value of the voltage sources takes place on the edges of both conducting planes, and makes allowance for the voltage drops due to the resistivity of the two conducting planes.

This is applicable to the two embodiments of the invention.

According to an embodiment of the invention, the two edges of the first conducting plane through which the plane is supplied are cut out to form electrical contact points locally isolated from one another and regularly spaced, each supplied by a respective individual voltage source.

If the voltages applied by the individual sources vary in a monotonic manner along each edge, this variation is preferably linear. In a variant, they vary along each edge according to a parabolic curve.

In a variant, individual control means enable each of these sources to be cut off or switched on. Notably, individual voltage sources can be switched off (that is to say, the output of the source can be put into high impedance mode or isolated from the conducting plane locally) as a function of content of the image to be displayed. When switched off, the source is disconnected from the contact point to which it is linked.

As indicated above, a second power conducting plane is provided, taking a second supply voltage to each of the pixels. According to the invention, it is possible to provide a similar arrangement to that of the first plane; that is to say, the second plane is rectangular and supplied by two adjacent edges corresponding to the two adjacent edges of the first conducting plane. These edges may also be cut out to form contact points for the connection to the second supply voltage. Each of the contact points of the second plane is preferably superimposed facing a gap between two contact points of the first conducting plane.

According to one aspect of the invention, the second conducting plane is an earth plane, and a single earth potential is applied to each of the contact points of the second conducting plane. Alternatively, a series of potentials is applied to each of the contact points of the second conducting plane.

The conducting planes may or may not be transparent, the invention being especially applicable when they are transparent, since their resistivity is higher than that of non-transparent planes (which may be made of aluminium). The planes may be deposited in the form of a uniform layer or may be perforated opposite each pixel (forming grid-like planes).

The invention is applicable, in particular, to an electro-optical device with a pixel matrix using light-emitting diodes, notably using organic light-emitting diodes.

BRIEF DESCRIPTION OF THE DRAWINGS

Other characteristics and advantages of the invention will be apparent from the following detailed description, with reference to the attached drawings, in which.

DETAILED DESCRIPTION

By convention, the same notation is used to identify elements common to the figures. Since the conducting planes and the active zone ZA are superimposed rectangular planes, the same notations b1, b2, b3, b4 are used to identify their corresponding edges.

Figure 4:
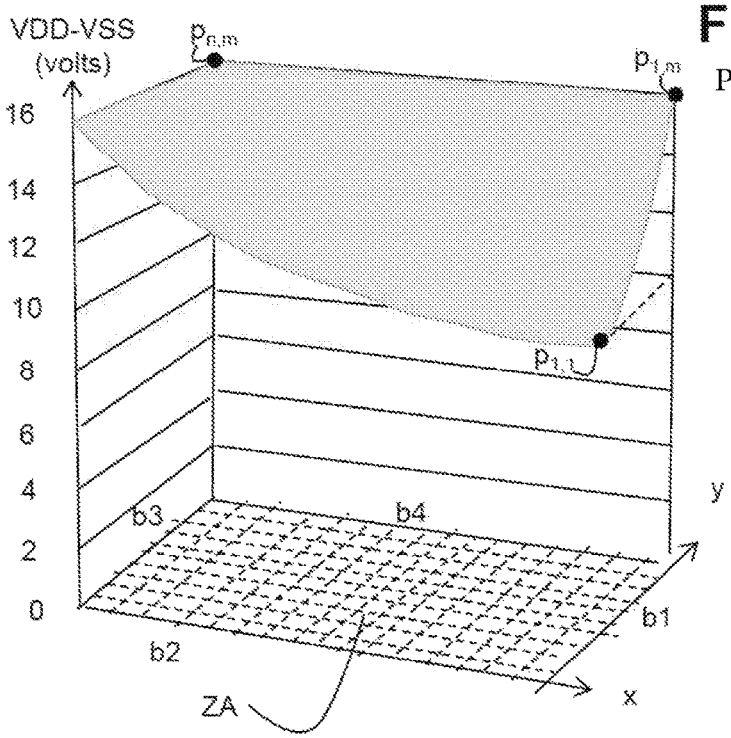
Fig. 4 Prior Art
FIG. 4 shows the non-uniform distribution of voltage over the pixels as a function of the distance to the power source.
Figure 5:
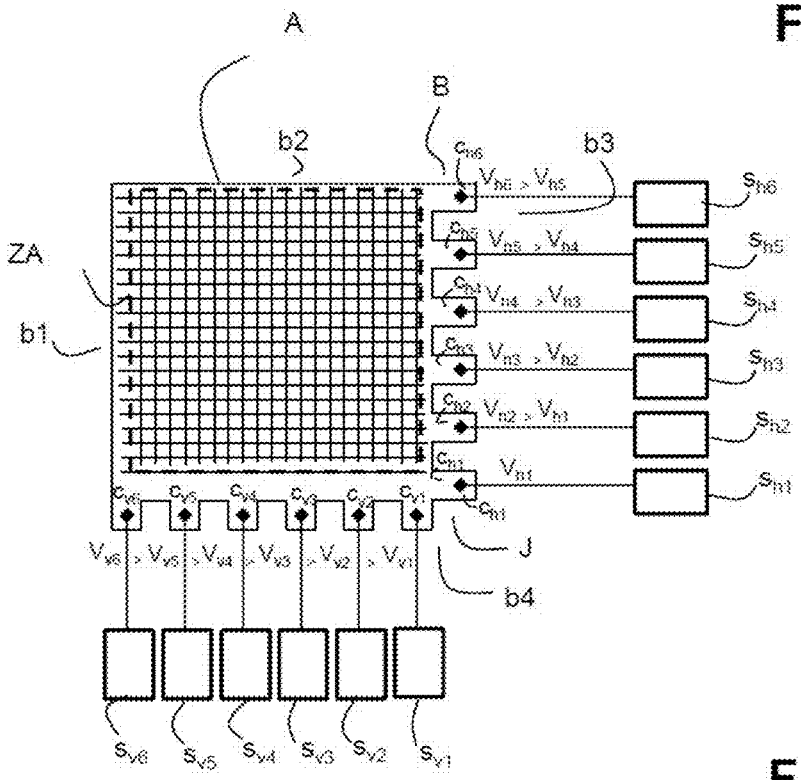
FIG. 5 shows a conducting plane for supplying the pixels, two adjacent edges of which are cut out to form the same number of electrical contact points, each intended for connection to an individual voltage source according to the invention.

FIG. 5 shows a conducting plane P1 for a power supply, provided in an electro-optical device to take a supply voltage to each of the pixels of an active matrix, as explained above with reference to FIGS. 1 to 4.

This is a plane of rectangular shape whose dimensions correspond to the dimensions of the pixel matrix that it is required to supply.

There are essentially two distinct zones of the plane, namely a central zone A covering the active zone ZA of the pixel matrix and a peripheral zone B located along the two adjacent edges b3 and b4.

The zone A may be a solid part or a perforated part, depending on whether the plane P1 is made with a plate or a grid structure.

The zone B forms a strip comprising the edges b3 and b4 of the plane, which is cut out, in a periodic pattern, so as to form a plurality of contact points (at least five, but preferably several tens) isolated from one another and regularly spaced. This zone B is located outside the active zone.

Notably, considering the example of an OLED matrix with upward emission, this strip is outside the active zone of the organic layers. It may be cut out by any appropriate method without risk of damage to the fragile layers that may lie above it. It may be formed by vacuum evaporation of a metal through a mask.

Each of these contact points is connected to an individual voltage source. Along each of the two adjacent edges b3 and b4, the number of individual power sources provided is equal to the number of contact points formed by the cut-outs of the zone B. These individual voltage sources have different values of voltage. In the example described here, the values of the voltage sources vary in a monotonically increasing manner (only the power supply plane VDD supplying current to the pixels is considered here; the voltage would decrease in the case of a power supply plane VSS receiving or drawing the current from the pixels) between a lower value at the end near the junction J between the two adjacent edges (corresponding to the bottom right-hand corner of the plane in the figure) and a higher value at the other end of each of the edges.

In the case of the edge b3, starting from the junction J between the two edges b3 and b4, and proceeding towards the other end corresponding to junction of the edges b3 and b2, we thus find a plurality of contact points $c_{h1}$ to $c_{h6}$, each connected to a respective individual voltage source $s_{h1}$ to $s_{h6}$ applying a different supply voltage $v_{h1}$ to $v_{h6}$, where $v_{h1}<v_{h2} \ldots <v_{h6}$.

In the case of the edge b4, starting from the junction J between the two edges b3 and b4, and proceeding towards the other end corresponding to junction of the edges b4 and b1, we find a plurality of contact points $c_{v1}$ to $c_{v6}$, each connected to a respective individual voltage source $s_{v1}$ to $s_{v6}$ applying a different supply voltage $v_{v1}$ to $v_{v6}$, where $v_{v1}<v_{v2} \ldots <v_{v6}$.

The size (depth and width) of the cut-outs in the plane is determined according to the prior art to prevent any short circuit between two adjacent contact points. The connection between each of these points and an individual power source is made according to the prior art, with minimum terminating impedance.

With a conducting plane cut out and supplied with power according to the principle described above, the voltage supply to the conducting plane P1 is distributed in a monotonic manner along the edges b3 and b4: this distribution is monotonically increasing or monotonically decreasing, depending on whether the plane supplies current to the pixels or draws current received from the pixels. This monotonic distribution is such that the voltage difference between the voltages applied to two adjacent contact points is sufficient small to prevent the creation of a short circuit between these two points.

In the case of an application in which the pixels are supplied with power by two conducting planes as described with reference to FIGS. 3 and 4, with a first conducting plane connected to a power source VDD and a second conducting plane connected to a common electrical earth, the first conducting plane is formed and supplied according to the invention, as has been explained with reference to FIG. 5.

The monotonic function may be a linear function: the individual voltage sources along an edge are designed to apply a voltage gradient.

The monotonic function may also define a parabolic curve. It has been found that this can reduce the consumption further by several watts, compared with a linear increase.

In practice, this monotonic function and the minimum and maximum voltages will be defined as a function of the voltages required for the operation of the pixel in the technology concerned, and as a function of the size and resistance per unit of surface area of the first conducting plane at least. A more advanced approach will also allow for the size and resistance per unit of surface area of the second conducting plane and therefore of the variation in the potential difference between VDD and VSS.

Figure 6:
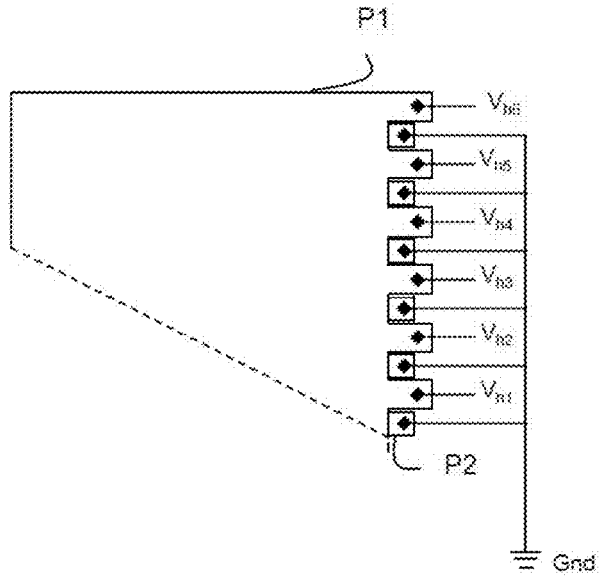
FIG. 6 shows an embodiment of the invention in which a power conducting plane and a conducting plane connected to earth have their same two adjacent edges cut out, the cut-out of one being fitted, in a top view, into the cut-out of the other in such a way that a contact point connected to the electrical earth is placed between two contact points, each of which is connected to a respective individual voltage source.

Advantageously, and as shown in FIG. 6, the other conducting plane P2 for connecting the pixels to a common electrical earth is formed in a similar way to the conducting plane P1, with cut-outs along the edges b3 and b4 to form on these edges the same number of electrical contact points as on the plane P1. These contact points formed on the second plane are all connected to a common potential, typically the electrical earth. Alternatively, if the plane P2 forms the negative side of the power supply, it would also be possible to apply a monotonic voltage that decreases from the junction between the two adjacent edges b3 and b4.

Since the two planes are superimposed in practice, the cut-outs of the second plane are offset on each edge with respect to those of the other plane, in such a way that each contact point of the plane P2 is located in a gap between two contact points of the plane P1.

The invention has been described with reference to an electro-optical device in which the distribution of power to the pixels uses two power conducting planes, one connected to a supply voltage VDD, and the other connected to an electrical earth (voltage VSS) common to all the pixels.

The invention is not necessarily limited to this configuration. It is more generally applicable to devices using two power conducting planes, of which one supplies current and the other draws current.

Figure 7:
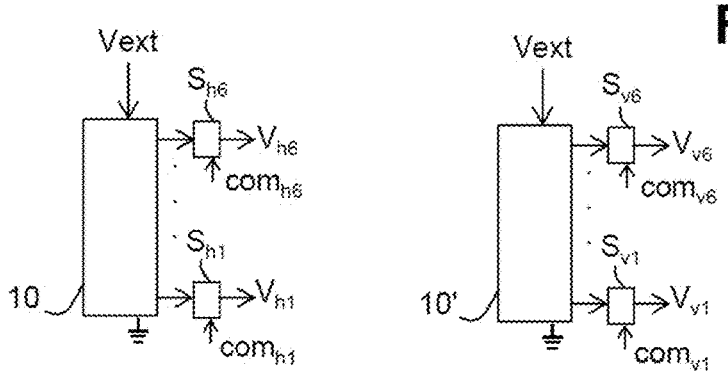
FIG. 7 is a block diagram of a control circuit of the individual voltage sources for supplying supply voltages according to a specified increasing monotonic function.

The individual voltage sources may in practice be formed by operational amplifiers with a low output impedance, adapted to deliver a high current (a positive current for power conducting planes supplying current to the pixels, or a negative current for conducting planes drawing the current received from the pixels). Their output voltages are provided, for example, by means of a suitable circuit configured to reproduce the desired monotonic function for this edge, for example a resistive divider circuit, or a digital-to-analogue converter. In practice, as shown in FIG. 7, there is a device 10 of this type for all the sources $S_{h1}$ to $S_{h6}$ supplying the plane via the edge b3 and another device of this type 10' for all the sources $S_{v1}$ to $S_{v6}$ supplying the plane via the edge b4. In the example, both the devices 10 and 10' are connected to the same power source (Vext).

Although the number of electrical contact points, and therefore of individual voltage sources, is the same for both edges b3 and b4 in the examples that have been described and illustrated, this number is determined for each of the edges in accordance with the dimensions of the plane and with the estimate of the ohmic losses over the pixels.

Figure 1:
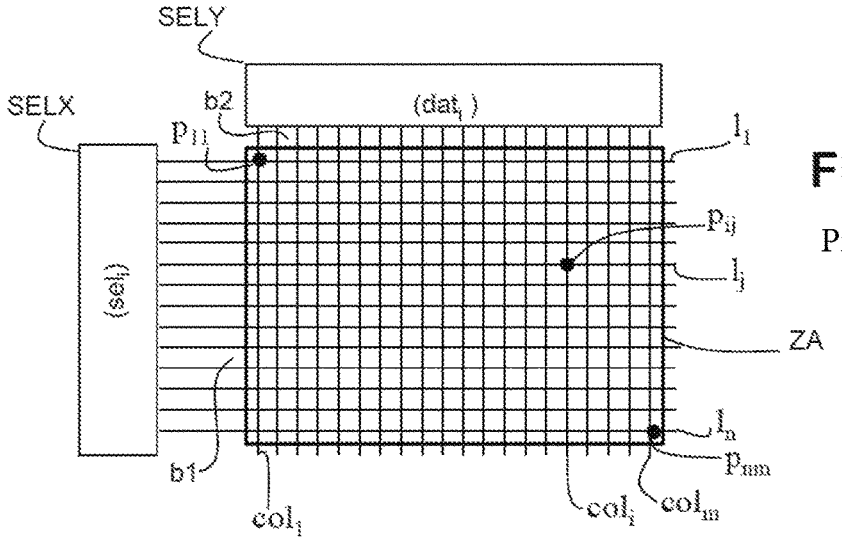
Fig. 1 Prior Art
FIG. 1 is a block diagram of an active pixel matrix.
Figure 2:
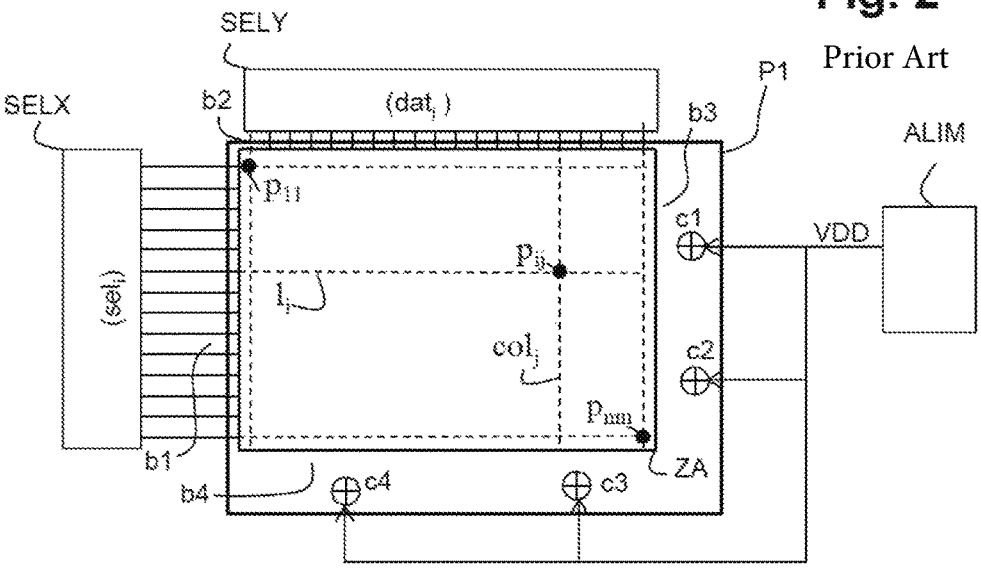
Fig. 2 Prior Art
FIG. 2 shows the distribution of a supply voltage by a conducting plane connected to a power source in a matrix of this type.
Figure 3:
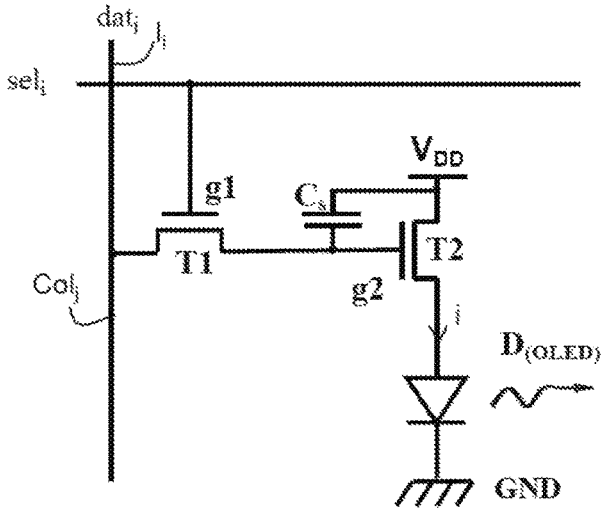
Fig. 3 Prior Art
FIG. 3 shows a basic layout of an OLED pixel with an elementary control circuit (active matrix)
Figure 8:
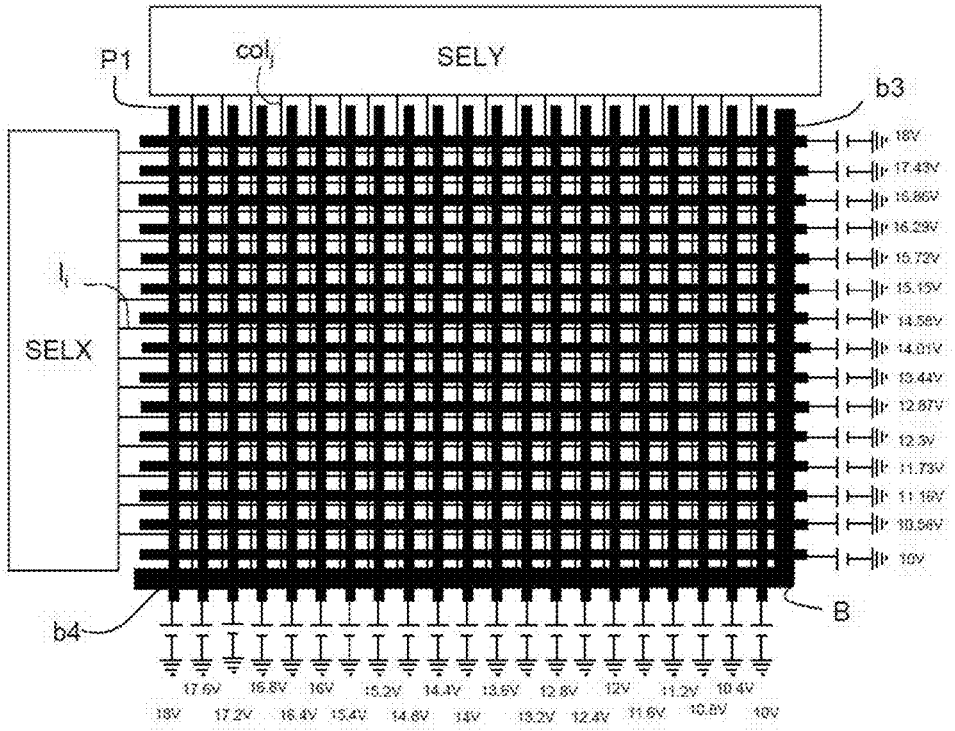
FIG. 8 is an exemplary embodiment of the invention.

Taking the example of the 15.4 inch OLED screen used to explain the voltage distribution over the matrix and the effects on power consumption in relation to FIG. 3, the rectangular conducting plane supplied by the edging B comprising the edge b3 and the edge b4 may, for example, be cut out and supplied as shown in FIG. 8:

the first edge b3 has a cut-out forming 15 regularly spaced contact points to be connected to the same number of individual voltage sources configured to deliver 15 different voltages, one per point; the second edge b4 will have a cut-out forming 21 contact points to be connected to the same number of individual voltage sources configured to supply 21 different voltages, one per point.

In this example, the two sets of voltages each vary along the respective edge according to an increasing monotonic function, which is a linear function (voltage gradient) in the example, between a minimum and a maximum value, which may be different for each of the edges, and which will depend, notably, on the dimensions and electrical conduction properties of the conducting plane, which are functions of its structure and the material used. In the illustrated example, the maximum values are equal for the two edges.

In the illustrated example, the conducting plane is in the form of a grid, that is to say a network of rows and columns all connected to each other) with a mesh in the zone (zone A in FIG. 5) covering the active zone corresponding to the pitch of the pixels; and an edging B is formed as a wider strip along the edges b3 and b4, having a cut-out according to the invention.

In order to simplify the drawing, the mesh of the grid is shown as having the same pitch as the pitch of the contact points.

In reality, the mesh of the grid is much closer than the pitch of the contact points.

With the voltages shown, in order to display an entirely white image on a 15.4 inch OLED screen in the same conditions and with the same parameters as those mentioned previously with reference to FIG. 4, a power consumption of 223 watts is required, made up of 190 watts in the diodes and 33 watts in the conducting plane. Thus the power consumption is improved by 10% in the case of a uniform supply to the plane according to the prior art at 16 volts.

In the example described above, the series of voltages applied to an edge is monotonically increasing for the power supply plane VDD which supplies the current (it would be monotonically decreasing for the power supply plane VSS which draws the current), to allow for the resistivity of the plane concerned. The increasing/decreasing monotonic function is in practice determined to optimize the potential difference at every pixel of the matrix, with allowance for its distance from the contact points through which the plane is supplied.

However, the invention can be applied more generally to any variations of voltage, not necessarily monotonic ones, particularly variations determined as a function of the content of the image to be displayed, so as to minimize the supply voltage at all points of the conducting plane. The preliminary analysis of the potential distributions at all points of the conducting plane makes it possible to optimize the voltages to be applied to the contact points so as to ensure that a minimum voltage required for the operation of the LEDs is applied to them, in all of the pixels. Thus, regardless of the image, the potential difference between the conducting planes is optimized in every pixel of the device, so as to achieve minimum power consumption. This may be done either by modifying the values of the voltage sources, or, in some cases, by the simple disconnection (by providing a high output impedance or local isolation) of some of the sources.

In order to obtain non-monotonically variable voltages over the series of contact points, it is possible to use a series of digital-analogue converters, each followed by a power amplifier. The converters may receive digital data from a table or from a memory, depending on the desired voltage values.

If an image to be displayed has a uniform hue, monotonic voltage variations will be found along the edges.

If the image to be displayed comprises gradations of hue, these variations may be of any kind.

These digital data are, in practice, supplied by an image processing microprocessor, adapted to analyse the image content to be displayed and to allow for the resistivity of one or both of the conducting planes. This embodiment has the advantage of facilitating programming. It should be noted that this facility can be utilized equally well by using these converters and associated programming means to supply the series of monotonically increasing or decreasing voltages of the first embodiment.

Figure 9:
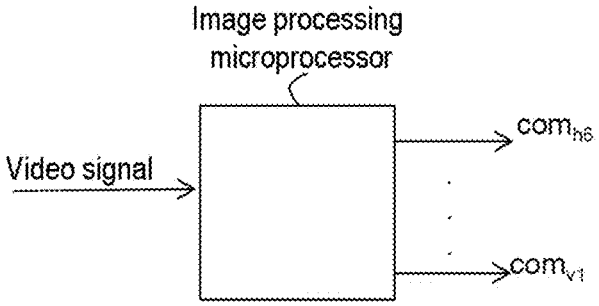
FIG. 9 is a block diagram showing a variant of the invention providing individual means for controlling the supply voltage sources, enabling each of the voltage sources to be switched on or off as a function of the content of a video image to be displayed.

In an improvement, the image processing microprocessor (FIG. 9) adapted to analyse the content of the image to be displayed can be made to supply control signals for switching the voltage sources on or off individually: these are the signals $com_{h1}$ to $com_{h6}$ for the sources $S_{h1}$ to $S_{h6}$ along the edge b3, and the signals $com_{v1}$ to $com_{v6}$ for the sources $S_{v1}$ to $S_{v6}$ along the edge b4, as shown in FIG. 7.

Notably, voltage sources can thus be switched off as a function of the content of the image to be displayed. When switched off, the source is disconnected from the contact point to which it is linked.

Figure 10:
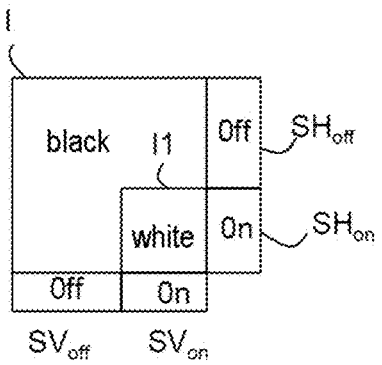
FIG. 10 shows a use of these means.

FIG. 10 illustrates this possibility: an image I to be displayed comprises only one white region in the zone I1 at the bottom right-hand part of the screen, and, since all the rest of the image is black, the microprocessor can switch off some of the sources along each edge.

This possibility of controlling individual voltage sources is, notably, very suitable for the control of active matrix lighting devices, enabling different lighting patterns to be created.

The invention described above is applicable to large active matrix electro-optical devices, particularly those using light-emitting diodes, notably organic light-emitting diodes.

The invention claimed is:

1. A pixel matrix electro-optical device, having a first and a second conducting plane supplying a first and a second supply voltage to each pixel of the matrix, the first conducting plane being rectangular and supplied mainly via two adjacent edges, wherein the power supply to the first conducting plane at least is provided from a series of individual voltage sources distributed along each of the two adjacent edges, the voltage sources being adapted to apply different respective voltages to a series of contact points provided on each of the two adjacent edges of the plane, and in that the voltages applied to these contact points by the voltage sources vary in a monotonic manner between a first value at a first contact point at the end near the junction between the two adjacent edges and a second value at a final point at the other end of each of the edges, with a monotonically increasing variation for a power conducting plane that supplies current or a monotonically decreasing variation for a power conducting plane that draws current.

2. The device of claim 1, wherein the voltages applied by the individual sources vary along each edge in a linear manner.

3. The device of claim 1, wherein the voltages applied by the individual sources vary along each edge according to a parabolic curve.

4. The device of claim 1, wherein the two edges through which the first conducting plane is mainly supplied are cut out to form electrical contact points locally isolated from one another and regularly spaced, each supplied by a respective individual voltage source.

5. The device of claim 4, wherein the second conducting plane is rectangular and mainly supplied via two adjacent edges which correspond to the two adjacent edges of the first conducting plane, and which are cut out to form contact points for connection to the second supply voltage.

6. The device of claim 5, wherein, the two planes being superimposed, their cut-out edges are such that each of the contact points of the second plane is superimposed facing a gap between two contact points of the first conducting plane.

7. The device of claim 5, wherein the second conducting plane is an earth plane, and a single earth potential is applied to each of the contact points of the second conducting plane.

8. The device of claim 1, comprising individual control means adapted to cut off and/or switch on each of the sources individually.

9. The device of claim 1, with a pixel matrix using light-emitting diodes, notably using organic light-emitting diodes.

10. The of claim 1, wherein at least one conducting plane is at least partially transparent.

11. The device of claim 1, wherein at least one conducting plane is in the form of a grid.

12. The device of claim 1, comprising individual control means adapted to cut off and/or switch on each of the sources individually.

13. The device of claim 1, with a pixel matrix using light-emitting diodes, notably using organic light-emitting diodes.

14. The device of claim 6, wherein the second conducting plane is an earth plane, and a single earth potential is applied to each of the contact points of the second conducting planes.

15. A pixel matrix electro-optical device, having a first and a second conducting plane supplying a first and a second supply voltage to each pixel of the matrix, the first conducting plane being rectangular and supplied mainly via two adjacent edges, wherein the power supply to the first conducting plane at least is provided from a series of individual voltage sources distributed along each of the two adjacent edges, the voltage sources being adapted to apply different respective voltages to a series of contact points provided on each of the two adjacent edges of the plane, so as to minimize the supply voltage at all points of the conducting plane.

16. The device claim 15, wherein the voltages supplied by the voltage sources are determined as a function of the content of the image to be displayed, so as to optimize the potential difference between the conducting planes at all points of the electro-optical device.

17. The device of claim 15, wherein the two edges through which the first conducting plane is mainly supplied are cut out to form electrical contact points locally isolated from one another and regularly spaced, each supplied by a respective individual voltage source.

18. The device of claim 15, comprising individual control means adapted to cut off and/or switch on each of the sources individually.

19. The device of claim 15, with a pixel matrix using light-emitting diodes, notably using organic light-emitting diodes.

* * * * *